US007670273B2

(12) United States Patent
Murray

(10) Patent No.: US 7,670,273 B2
(45) Date of Patent: Mar. 2, 2010

(54) APPARATUS FOR MANUFACTURING A POUCH WITH A STRAW HOLE

(75) Inventor: R. Charles Murray, Lakewood, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 402 days.

(21) Appl. No.: 11/535,220

(22) Filed: Sep. 26, 2006

(65) Prior Publication Data

US 2007/0154117 A1 Jul. 5, 2007

Related U.S. Application Data

(63) Continuation of application No. 10/255,014, filed on Sep. 25, 2002, now abandoned.

(51) Int. Cl.
*B31B 1/72* (2006.01)

(52) U.S. Cl. ..... 493/116; 493/150; 493/189; 493/197

(58) Field of Classification Search ..... 493/116, 493/212, 150, 189, 196, 197, 199, 200, 202, 493/209, 235

See application file for complete search history.

(56) References Cited

U.S. PATENT DOCUMENTS 4,120,715 A * 10/1978 Ockwell et al. ..... 156/252
4,553,693 A 11/1985 Terajima et al.
5,254,073 A * 10/1993 Richison et al. ..... 493/195
5,425,583 A 6/1995 Wild et al.
5,765,345 A * 6/1998 Svec ..... 53/453
5,833,368 A 11/1998 Kaufman
5,868,658 A * 2/1999 Wild ..... 493/212
5,873,656 A 2/1999 Arkins et al.
5,997,177 A 12/1999 Kaufman

* cited by examiner

*Primary Examiner*—Sameh H. Tawfik
(74) *Attorney, Agent, or Firm*—Gifford, Krass, Sprinkle, Anderson & Citkowski, P.C.

(57) ABSTRACT

An flexible pouch forming apparatus includes a transport means for transporting front and back panel films. A straw hole punch punches a straw hole with predetermined diameter in the front panel film. A seal material transport means unrolls a roll of seal material tape. A temporal hole punch punches a temporal hole in the seal material tape, and a guide means aligns the temporally punched section of seal material tape with the straw hole. A temporal heat sealing device temporally seals a periphery of the temporally punched section of seal tape material to the back side of the front panel film. An alignment station aligns the films to form the pouch body. A final heat seal means applies a final seal over the temporal heat seal at a lower temperature and pressure than the temporal heat seal. A seal means seals the edges, and a finishing station finishes the pouch.

1 Claim, 5 Drawing Sheets

APPARATUS FOR MANUFACTURING A POUCH WITH A STRAW HOLE

RELATED APPLICATION

This application is a continuation of U.S. patent application Ser. No. 10/255,014 filed Sep. 25, 2002.

FIELD OF THE INVENTION

The present invention relates to a pouch making it possible for users to insert a straw from a straw hole into, inside the inside of the pouch for drinking such drinks as juice or milk therein as well as to a method and apparatus for manufacturing the same.

BACKGROUND OF THE INVENTION

In a case of a pouch for drinks with a straw hole, the pouch is automatically manufactured by a bag making machine, so that substantial contrivance is required for sealing the straw hole from inside of the pouch.

In one of the methods known currently, a seal tape 22 is set inside the pouch in the horizontal direction as shown in FIG. 5 so that the seal tape 22 covers the straw hole 21 from inside thereof, and a circumference of the straw hole 21 indicated by the sign W in FIG. 7 and portions 24, 24*a* crossing the side seals 23, 23*a* in FIG. 5 and FIG. 6 respectively are heat-sealed.

Because of this feature, inside the pouch 20, a portion other than the heat-sealed area of the seal tape 22 is separated from the pouch 20 toward the content therein as shown in FIGS. 6 and 7, and this separated portion of the tape 22*a* sometimes cause troubles in filling content in the bag. Further the thickness of the sections where side seals 24, 24*a* are applied to the seal tape 22 is larger by the thickness of the seal tape 22 than that side seals 23 and 23*a*, so that sometimes pin holes may be generated due to a fault in heat sealing, and if the temperature for heat scaling is raised to address generating the pin holes, excessive heat is applied to other side seals 23 and 23*a*, which in turn may generate pin holes there.

In addition, as the thickness of the pouch 20 in the section where the seal tape 22 is applied becomes larger as compared to those in other areas thereof, and when these pouches 20 are set in a magazine of an automatic filling machine or the like, the pouches 20 are not well aligned, which may easily cause troubles.

Further, the content is easily stuck to and deposited on the tape 22*a*, and fungus or bacteria deposited on the tape 22*a* may cause contamination of the content.

OBJECTS OF THE INVENTION

The present invention was made in the light of the circumstances as described above, and it is an object of the present invention to provide a sanitary pouch with a straw hole which causes no trouble when the content is filled therein, and which does not generate any pin holes in the side-sealed sections, and also which does not cause any trouble in an automatic filling machine, and to provide a method and apparatus for manufacturing the pouch with a straw hole.

DETAILED DESCRIPTION OF THE INVENTION

Figure 1A:
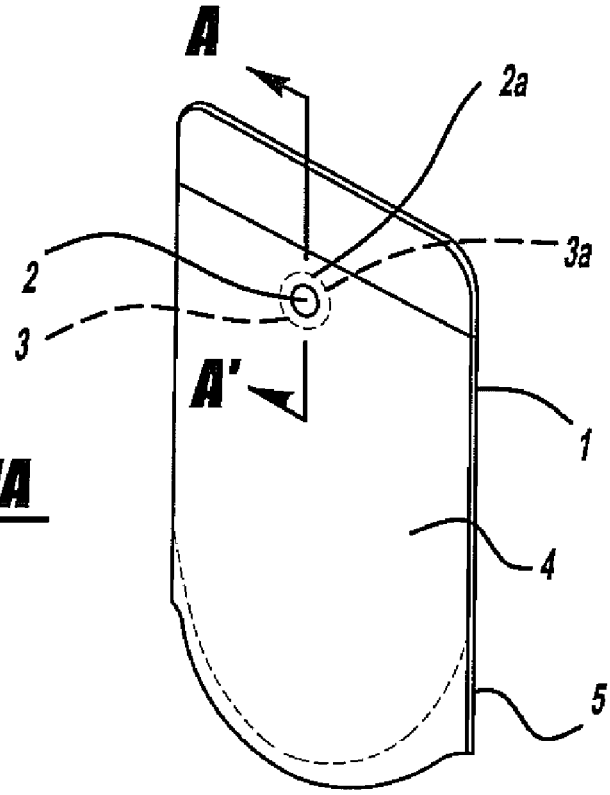
FIG. 1A is an explanatory view showing a standing pouch according to the present invention.
Figure 1B:
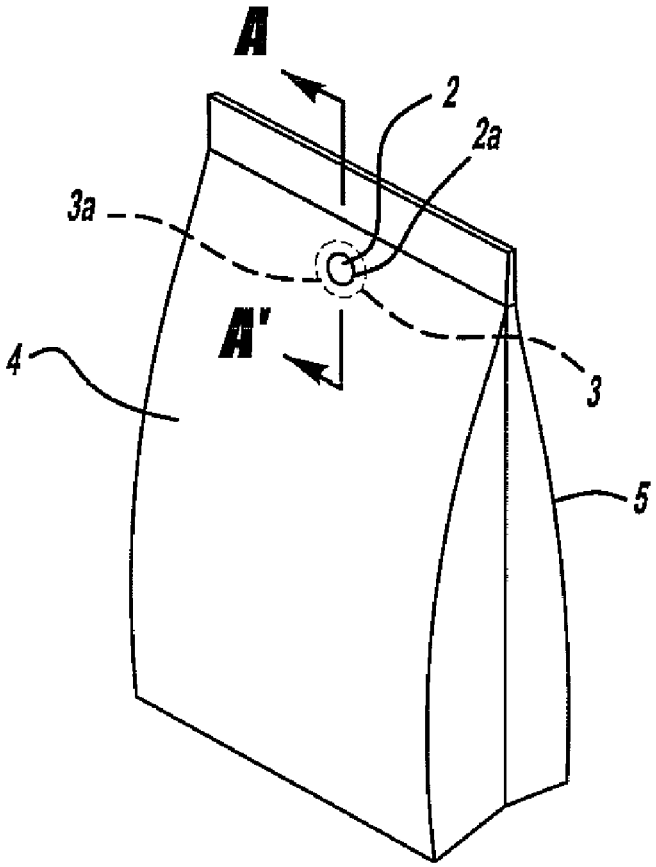
FIG. 1B is an explanatory view showing a gazette pouch according to the present invention.
Figure 1C:
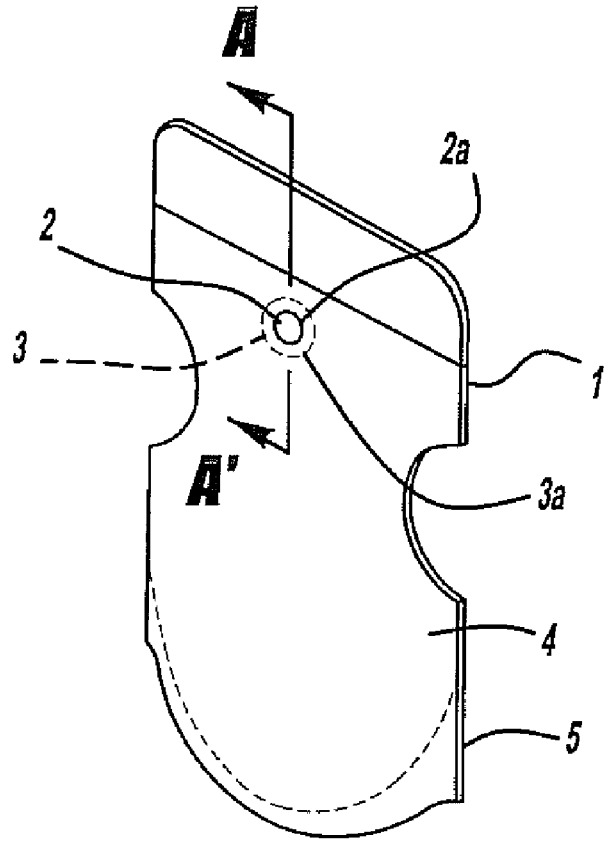
FIG. 1C is an explanatory view showing a standing pouch having cutting portion on the both sides.
Figure 2:
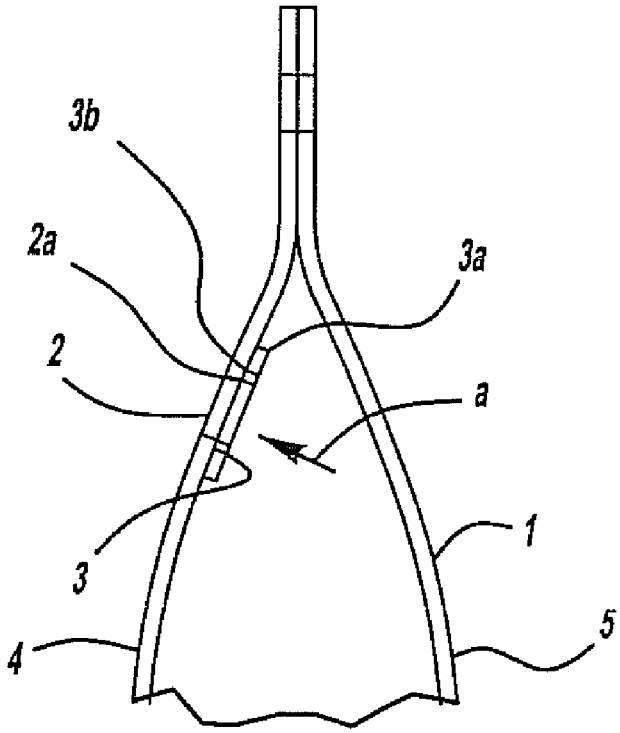
FIG. 2 is a view showing a cross section taken along the line A-A' in FIG. 1.
Figure 3:
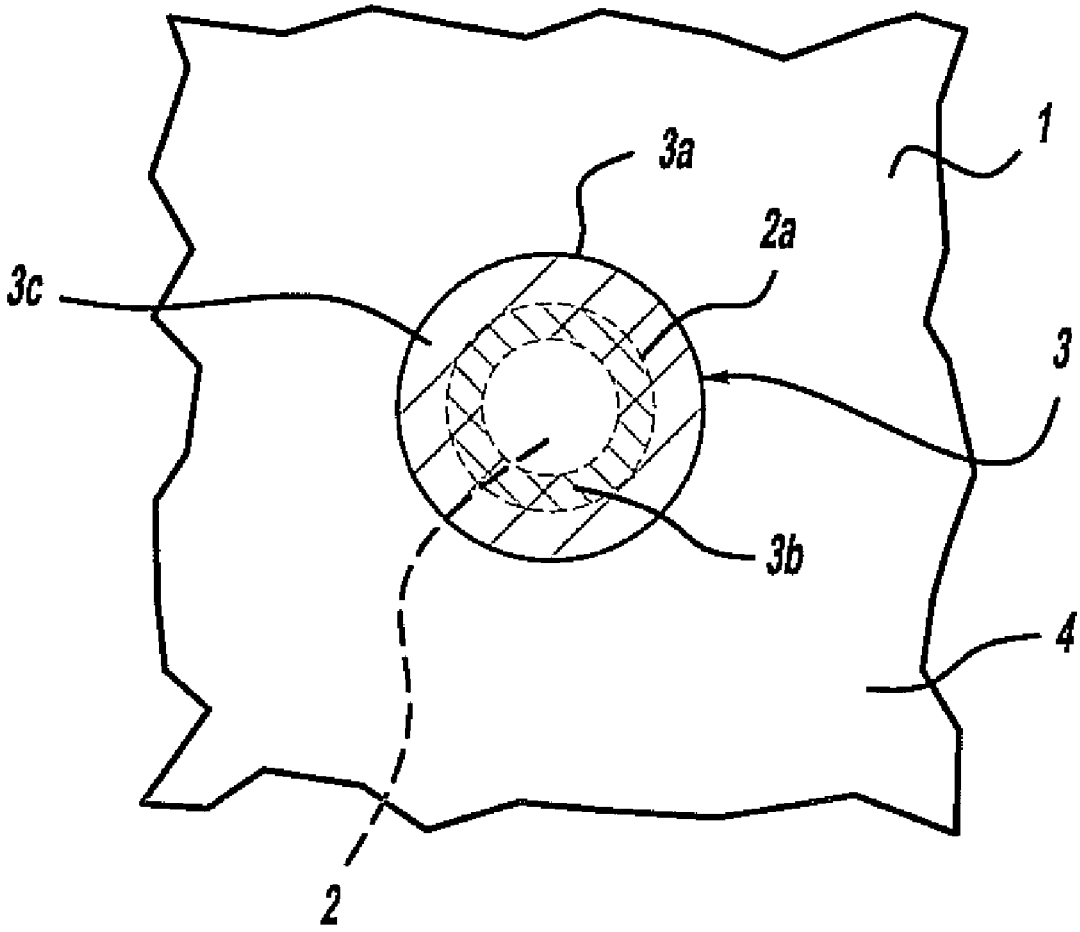
FIG. 3 is a front view seen in the direction a in FIG. 2.

FIGS. 1 to 3 each show a pouch according to the present invention. The pouch includes a front panel and a back panel. Each panel has a top edge, bottom edge. and side edges disposed between the top and bottom edge. The pouch may include a gusset inserted between two parallel edges, to form a pouch capable of standing up. The gusset may be formed from a folded tape of material.

The pouch 1 according to the present invention has a straw hole sealing material 3 with a circumference shown at 3*a* that is slightly larger than a straw hole 2 formed on a front-side film. The straw hole 2 also has a predetermined circumference shown at 2*a*. The straw hole sealing material 3 is first temporarily heat sealed to the back side of the front-side film over the straw hole 2. It should be appreciated that a peripheral portion of the straw hole sealing material is temporarily sealed to the back side of the front-side film around the straw hole 2 and has a temporary heat seal width as shown at 3*b*. The straw hole sealing material 3 is then permanently heat sealed to the back side of the front-side film and the permanent heat seal width shown at 3*c* is applied over the temporary heat seal width, Further, the circumference 3*a* of the straw hole sealing material 3 is slightly larger than that of either the permanent heat seal width 3*c* or temporary heat seal width 3*b*, and the permanent heat seal width 3*c* is slightly greater than the temporary heat seal width 3*b*. For example, the temporary heat seal width is 2 mm and the permanent heat seal width 3*c* is 2.5 mm. The temporary heat seal and permanent heat seal may be applied using a thermal heat sealing process, or an ultrasonic heat sealing process, or a combination of these processes. The temporary heat seal is preferably a "tack" seal that softens the film so that the patch sticks to the back side of the front-side film. The tack seal is a fast, high temperature with minimum time and pressure heat seal process, while the permanent seal is at a lower temperature and pressure. A two-seal process is advantageous in enhancing the seal strength and durability.

Figure 4:
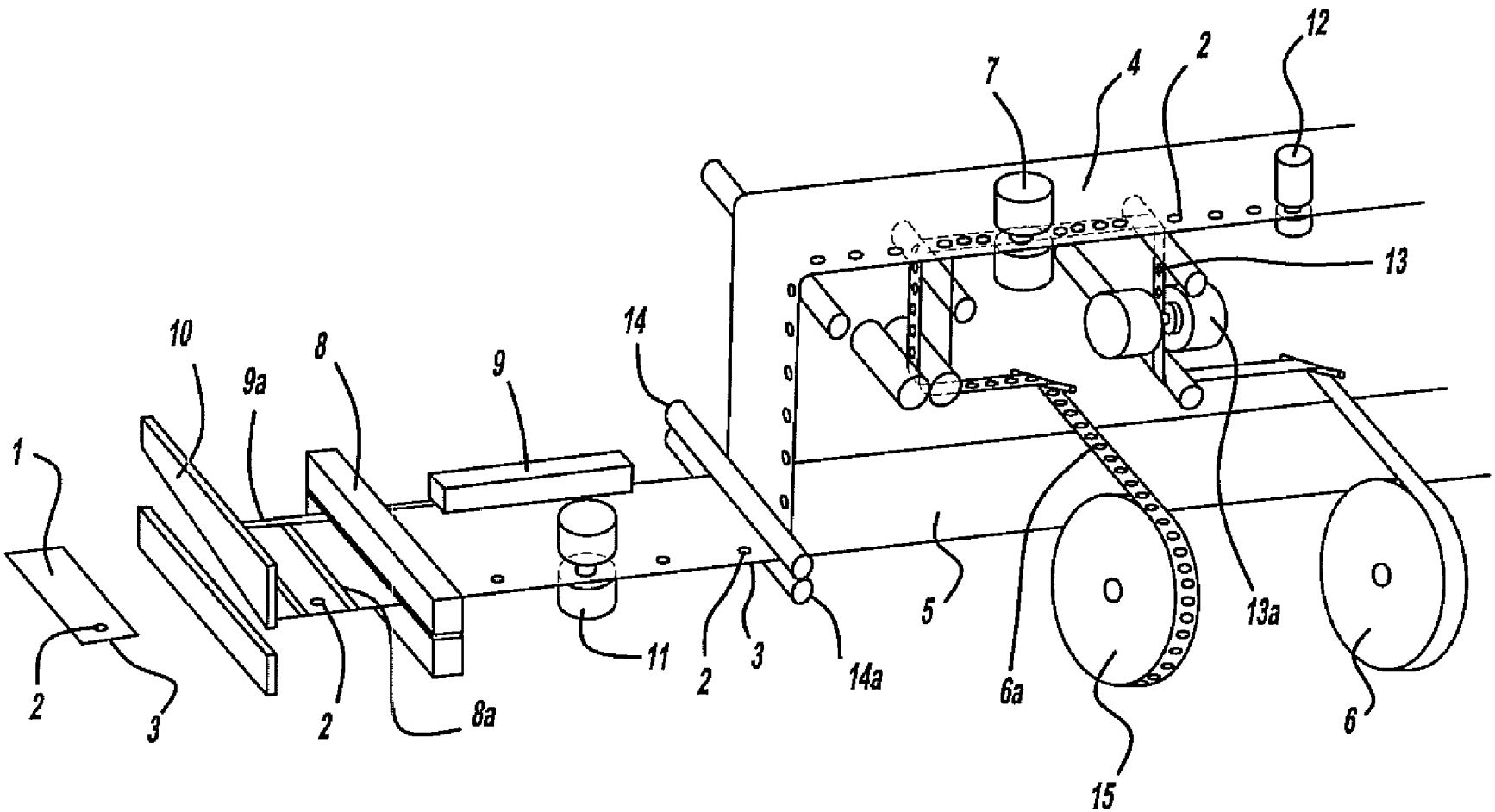
FIG. 4 is an explanatory view for a method of manufacturing the pouch according to the present invention.
Figure 5:
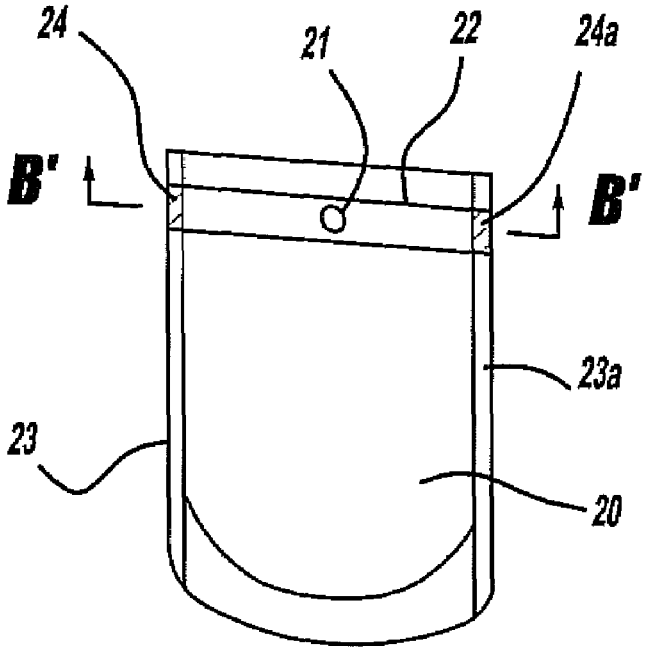
FIG - 5 Prior Art
FIG. 5 is an explanatory view showing a pouch with a straw hole based on the conventional technology.
Figure 6:
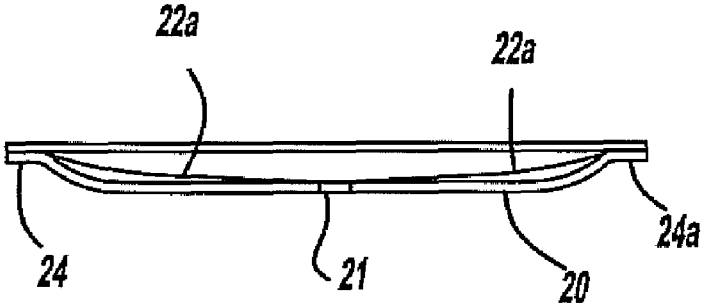
FIG - 6 Prior Art
FIG. 6 is a cross-sectional view taken along the line B'-B' of FIG. 5.
Figure 7:
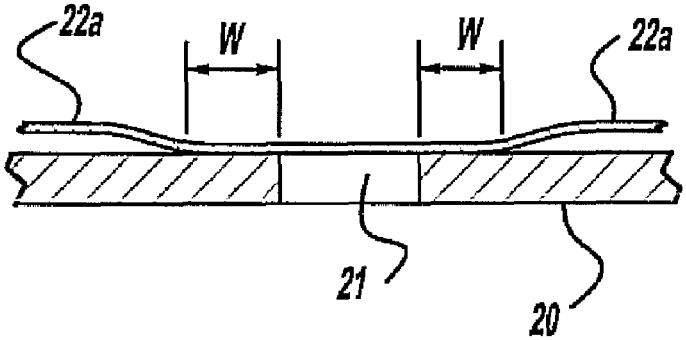
FIG - 7 Prior Art
FIG. 7 is an enlarged cross-sectional view showing the straw hole based on the conventional technology.

FIG. 4 shows a method of manufacturing the pouch 1 described above, and in this method, at first the straw hole 2 is punched by a straw hole punching machine 12 on the front-side film 4. Then a seal-material tape 6 is fed to the back side of this straw hole 2. This seal tape 6 has a hole temporally punched (or partially punched) by a temporally punching machine 13*a* with the size slightly larger than that of the straw hole 2. The temporally punched section 13 of this seal material tape 6 is guided to the back side of the straw hole 2, and then a periphery of the temporally punched section 13 is temporally heat-sealed by a temporally heat-sealing device 7. As previously described, the temporary heat seal is a "tack" seal. Then the front side film 4 and a rear side film 5 are aligned with each other by pinch rollers 14, 14*a*, and the section of the straw hole sealing material temporally sealed by the temporally sealing machine 7 is finally sealed by a finally sealing machine 11. The final seal is at a lower temperature and pressure than the first seal. A bottom seal 9*a* is applied by a bottom seal bar 9, and a side seal 8*a* is applied by a side seal bar 8. The pouch is finished, such as by cutting the pouch into discrete pieces by a cutter 10. It should be appreciated that prior to sealing the edge, a gusset may be inserted between parallel edges of each panel, for a stand-up pouch.

In this figure, the sign 15 indicates a reel which winds up the seal material tape 6*a* after the seal material 3 is punched out therefrom. It is appreciated that FIG. 4 also teaches that the seal-material tape 6 is also on a reel. As such, it is further appreciated that FIG. 4 teaches a first reel having a roll of seal material tape thereon that can be unrolled therefrom, and a second reel onto which the seal material tape can be wound onto.

As described above, in the pouch with a straw hole according to the present invention, only the back side of the straw hole is heat-sealed with a seal material, which provides the following advantageous effects.

1. In a manner that is different from the conventional type of pouches, there is no odd portion of the seal material of the invention that may cause a problem when the content is filled therein.

2. In a manner that is different from the conventional type of pouches, the seal material of the invention does not interfere with the side seal section, so that no pin holes are generated in the side seal section.

3. In a manner that is different from the conventional type of pouches, the pouch of the invention does not become thicker by the thickness of the seal material, so that no trouble occurs when the content is filled therein.

4. There is no odd tape left inside the pouch of the invention after sealing, so that the pouch is not contaminated by fungus or bacteria and the inside is always kept clean.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

The invention claimed is:

1. An apparatus for forming a flexible pouch that holds a product comprising:

a transport means for transporting a front panel film and back panel film each of a laminate material, wherein the front panel film and back panel film each have a front side and a back side;

a straw hole punch for punching a straw hole in the front panel film being transported by said transport means, wherein the straw hole has a predetermined diameter;

a seal material transport means for transporting a seal material tape, said seal material transport means having a first reel and a second reel, wherein said seal material transport means is operable to unroll a roll of the seal material tape that is located on said first reel and wind up the seal material tape onto said second reel after the seal material tape has been unrolled from said first reel;

a hole punch operable for partially punching a hole in a section of the seal material tape after the seal material tape has been unrolled from said first reel and before the seal material tape has been wound up onto said second reel, wherein the partially punched hole of the seal material tape has a diameter that is slightly larger than the predetermined diameter of the straw hole in the front panel film;

a guide means for aligning the seal material tape that has been unrolled from said first reel with the back side of the front panel film, wherein the partially punched hole of the seal material tape is aligned with the straw hole in the front panel film;

a first heat sealing station having a heat sealing device for tack sealing a periphery of the partially punched hole of the seal tape material to the back side of the front panel film, wherein said heat seal device separates the partially punched hole of the seal material tape from the seal material tape after the seal material tape has been unrolled from said first reel and before the seal material tape has been wound up onto said second reel;

an alignment station operable to align the unrolling front panel film with the unrolling back panel film to form a body of the pouch, wherein the body of the pouch includes a front panel and a back panel, with a top edge, a bottom edge and side edges extending therebetween the top edge and bottom edge;

a second heat sealing station operable to apply a final seal over the tack seal on the periphery of the partially punched hole wherein the final seal is applied at a lower temperature and pressure than the tack seal;

a seal means having a bottom seal bar and a side seal bar operable for forming a bottom edge seal and a side edge seal of the body of the pouch; and a finishing station for separating the pouch from the unrolling front panel film and back panel film.

* * * * *